US007341492B2

(12) United States Patent
Wang et al.

(10) Patent No.: US 7,341,492 B2
(45) Date of Patent: Mar. 11, 2008

(54) MODULAR JACK HAVING ELECTRICAL WIRES THROUGH A SIDE WALL THEREOF

(75) Inventors: Haiwei Wang, Kunsan (CN); Yi Sheng Lin, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 535 days.

(21) Appl. No.: 10/863,412

(22) Filed: Jun. 7, 2004

(65) Prior Publication Data

US 2004/0248473 A1 Dec. 9, 2004

(30) Foreign Application Priority Data

Jun. 5, 2003 (CN) ..... 03 2 65892

(51) Int. Cl.
*H01R 24/00* (2006.01)

(52) U.S. Cl. ..... 439/676; 439/607

(58) Field of Classification Search ..... 439/607, 439/417, 676

See application file for complete search history.

(56) References Cited

U.S. PATENT DOCUMENTS 5,304,074 A * 4/1994 Andre et al. ..... 439/417
5,885,111 A 3/1999 Yu
6,508,677 B1 * 1/2003 Wang ..... 439/676

* cited by examiner

*Primary Examiner*—Khiem Nguyen
(74) *Attorney, Agent, or Firm*—Wei Te Chung

(57) ABSTRACT

A modular jack (100) includes an insulative housing (2) and a terminal-receiving part (3) having a pair of terminals (4) therein received in the housing (2). The terminal-receiving part (3) includes a pair of through apertures (341) accommodating the terminals (4), a leading-wire notch (325) positioned behind the apertures (341) and a leading-wire space (324) communicating with the leading-wire notch (325). A hole (211) is defined in a corresponding side wall (21) of the housing (2). A pair of wires (344) connecting to leading-wire end (41) of the terminals (4) extends through the leading-wire notch (325) and leading-wire space (324) out of the hole (211) of the side wall (21) of the housing (2).

10 Claims, 6 Drawing Sheets

MODULAR JACK HAVING ELECTRICAL WIRES THROUGH A SIDE WALL THEREOF

BACKGROUND OF THE INVENTION

1. Field of the Invention

The present invention relates to connectors, and especially to a modular jack designed to thread electrical wires through a side wall thereof.

2. Description of the Prior Art

A modular jack connecting electrical wires usually threads electrical wires through a top wall or a rear wall of an insulative housing. U.S. Pat. No. 5,885,111 issued to Yu on Mar. 23, 1999 disclosed a modular jack. The modular jack comprises an insulative housing, a wires mounting plate installed to the insulative housing, wires secured in the wires mounting plate and a top cover mounted to a rear portion of the insulative housing. The top cover defines a through hole, the wires are educed through the hole. However, sometimes, for example a rear space of a modular jack is limited or an electrical element electrically connected to the modular jack is close to a side wall of the modular jack, and the wires are required to extend out of the housing through a side wall of the modular jack. Therefor, structures of the insulative housing and the wires mounting plate installed to the insulative housing cannot meet a requirement of threading the wires.

BRIEF SUMMARY OF THE INVENTION

An object of the present invention is to provide a modular jack with a hole in a side wall thereof for threading electrical wires.

A modular jack of the present invention comprises an insulative housing and a terminal-receiving part having a plurality of terminals therein received in the housing. The terminal-receiving part comprises a through aperture accommodating the terminals, a leading-wire notch aligned with a top portion of the aperture and a leading-wire space communicating with the leading-wire notch. A Hole is defined in a corresponding side wall of the housing. Wires connected to the terminals extend through the leading-wire notch and leading-wire space in turn, finally extending out of the hole of the side wall of the insulative housing.

DETAILED DESCRIPTION OF THE INVENTION

Figure 1:
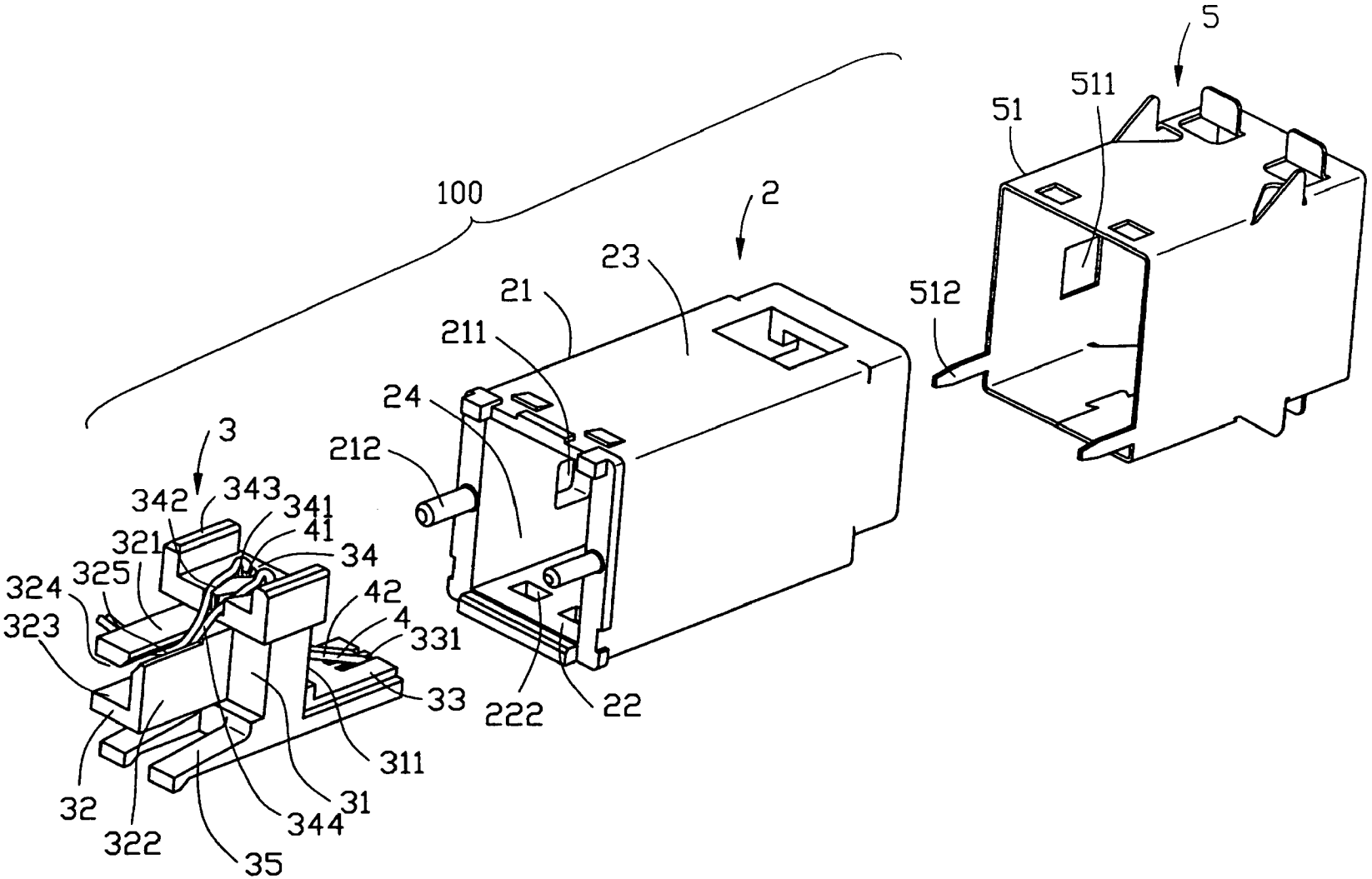
FIG. 1 is an exploded view of a modular jack according to the present invention.
Figure 2:
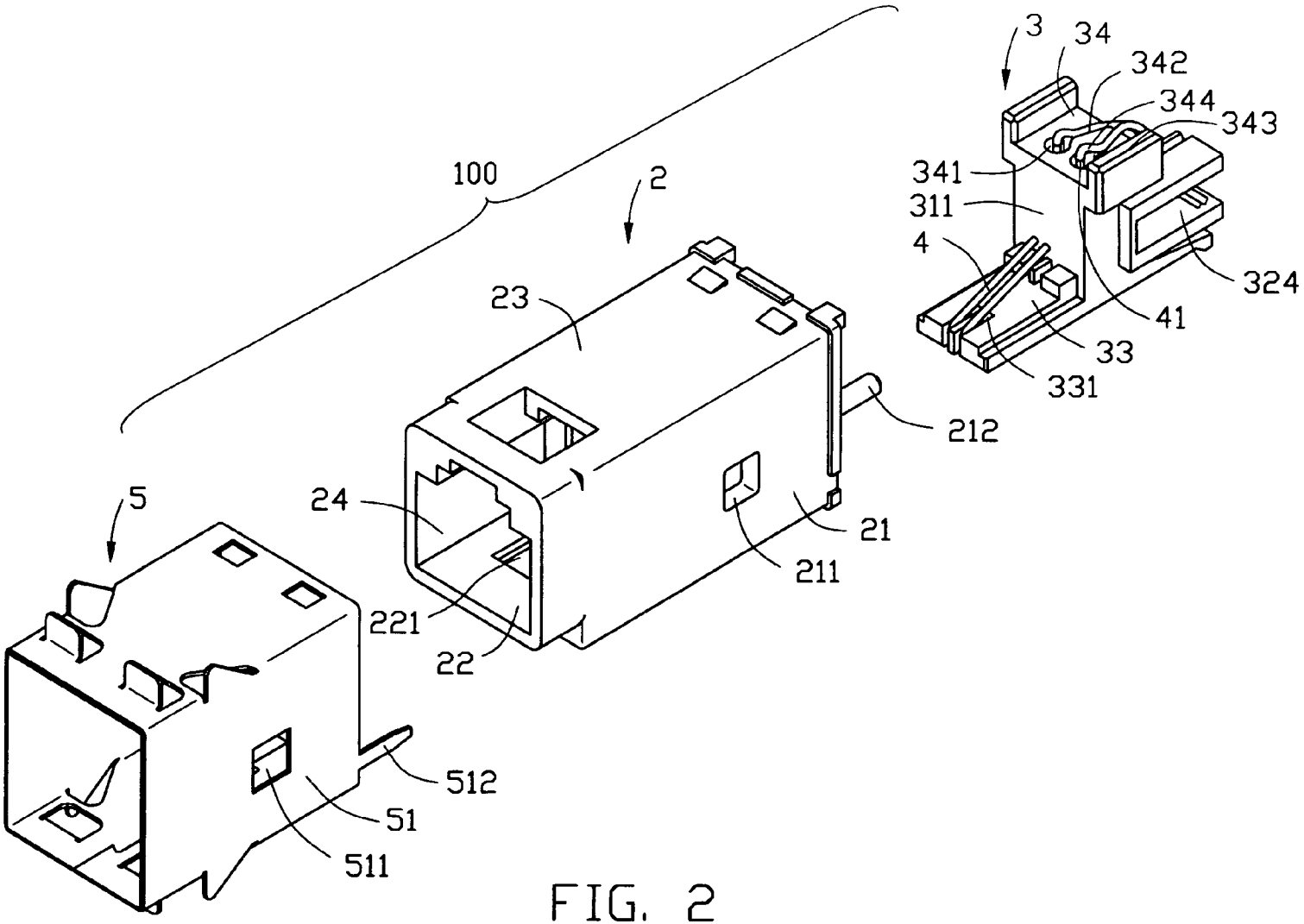
FIG. 2 is another exploded view of the modular jack of FIG. 1 from a front aspect.
Figure 3:
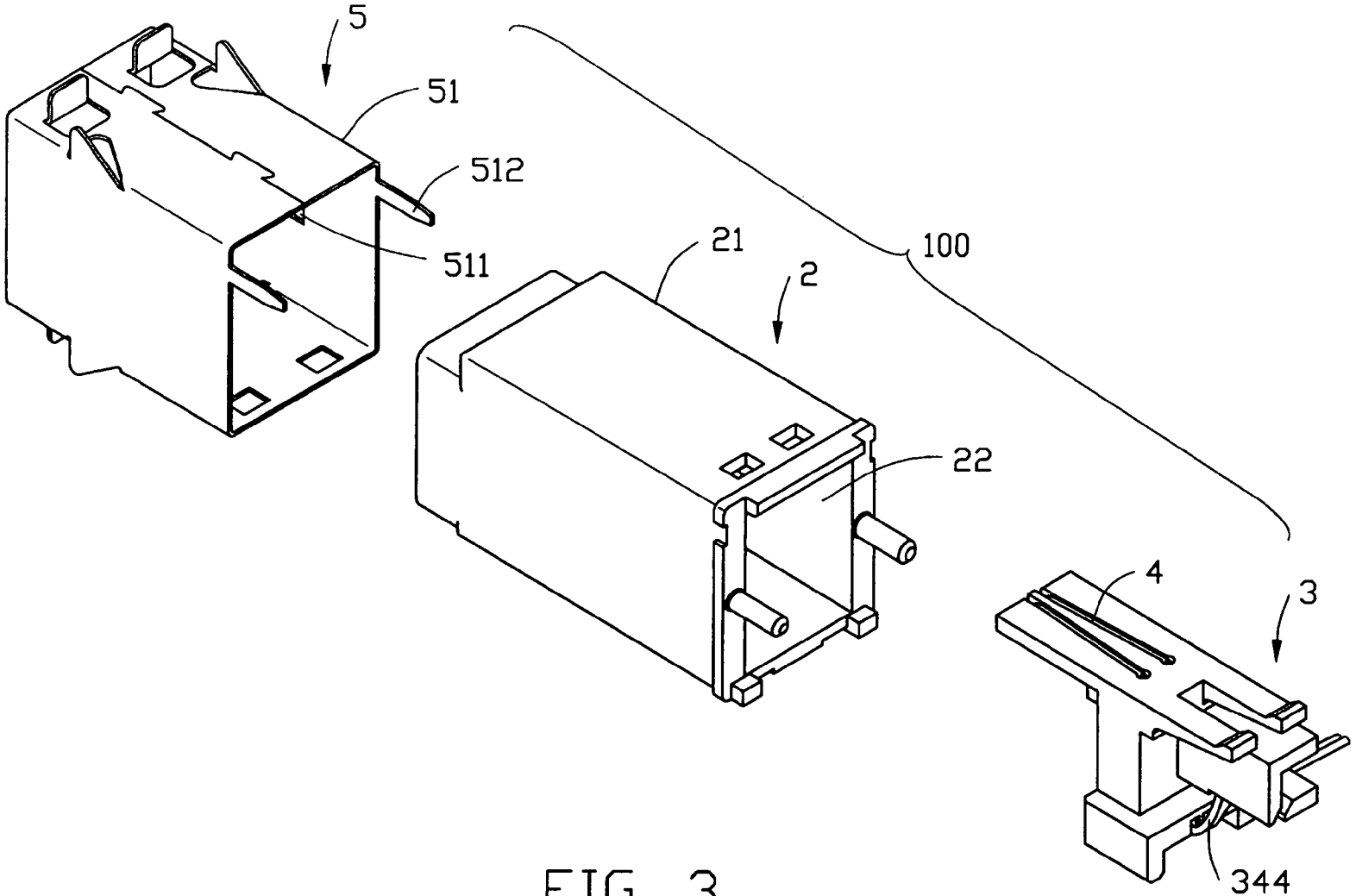
FIG. 3 is another exploded view of the modular Jack of FIG. 2 from a bottom aspect.
Figure 4:
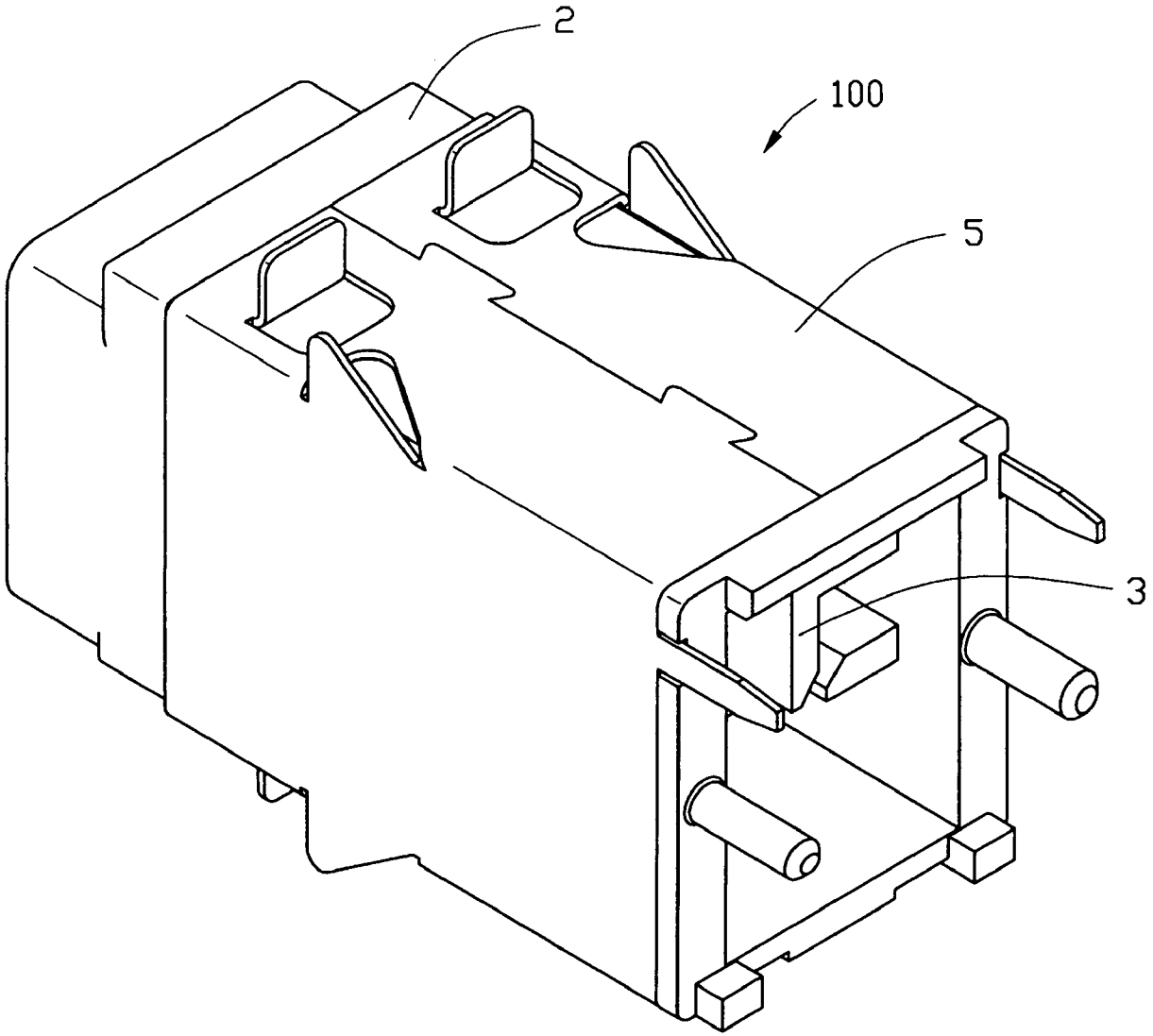
FIG. 4 is a perspective view of the modular Jack.
Figure 5:
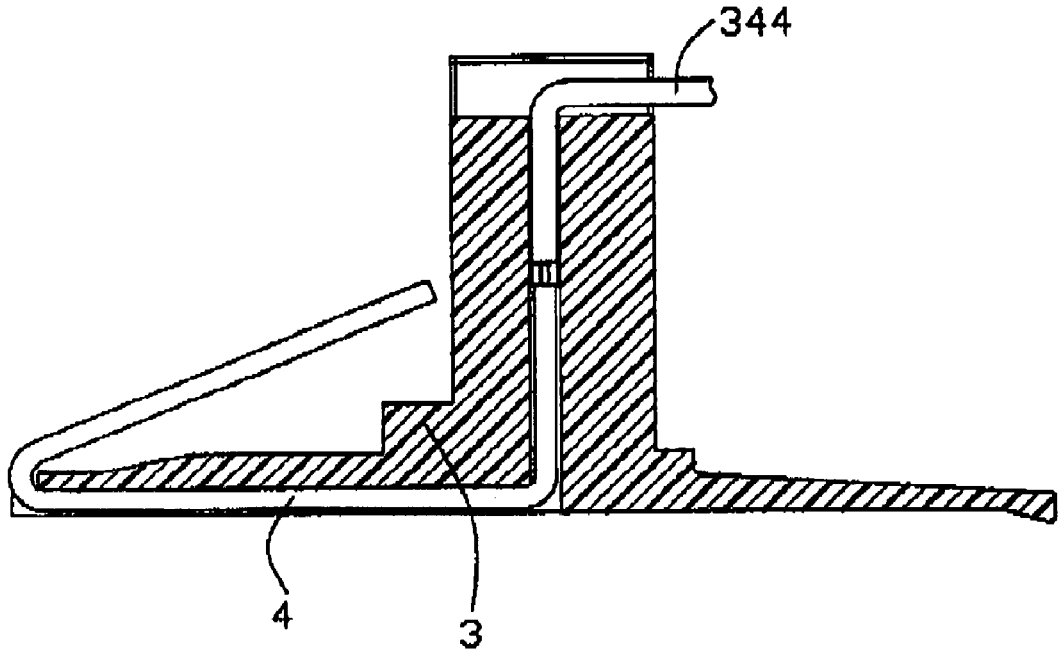
FIG. 5 is a cross-section view of the terminal-receiving part of the modular jack shown in FIG. 4.
Figure 6:
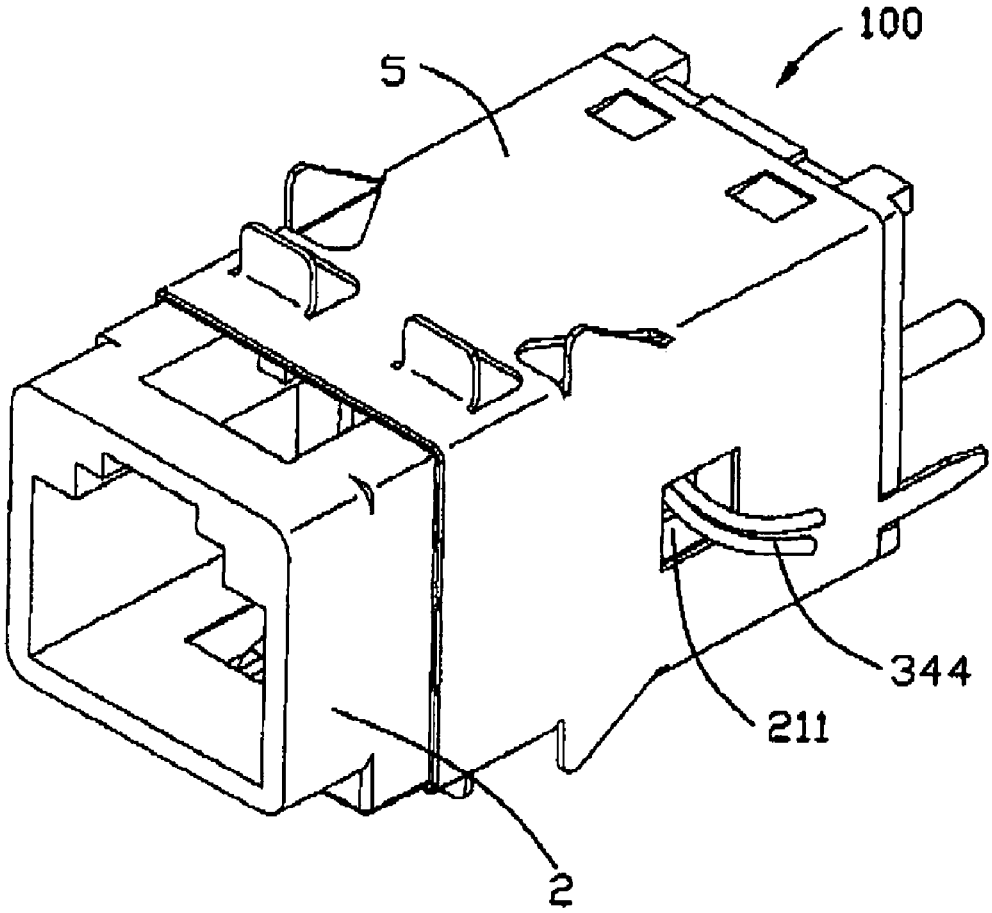
FIG. 6 is a view similar to FIG. 4, but taken from a different aspect.

Referring to FIGS. 1 and 3, a modular jack 100 comprises an insulative housing 2, a terminal-receiving part 3 received in the housing 2 and a metal shell 5 shielding the insulative housing 2.

The housing 2 is substantially rectangular and made from insulative material. The housing 2 comprises a pair of side walls 21, a bottom wall 22, a top wall 23, a plug-receiving cavity 24 defined therebetween. One of the side wall 21 defines a rectangular hole 211. Each side wall 21 includes a bolt 212 extending rearwardly from a rear end thereof for connecting a printed circuit board (not shown). The bottom wall 22 defines a rectangular receiving groove 221 in a front portion thereof and a pair of rectangular holes 222 therethrough in a rear portion thereof.

The terminal-receiving part 3, made from insulative material, is received in the housing 2. The terminal-receiving part 3 receives a pair of terminals 4. The terminal-receiving part 3 includes a base portion 31, a side portion 32 extending rearwardly from one side of the base portion 31, a horizontal portion 33 extending forwardly from a bottom portion of the base portion 31, a top portion 34 extending upwardly from the base portion 31 and a pair of legs 35 extending backwardly from a bottom portion of the base portion 31. The base portion 31 has a front face 311 supporting free ends of contact portions (will be described later) of the terminals 4. The side portion 32 includes a top wall 321, a side wall 322, a bottom wall 323, and a leading-wire space 324 defined therebetween. The leading-wire space 324 communicates with the hole 211 of the housing 2. The top wall 321 defines a leading-wire notch 325 communicating with the leading-wire space 324. The horizontal portion 33 defines a pair of slits 312. The top portion 34 defines a pair of through apertures 341 extending vertically, a pair of leading-wire cutouts 342 extending substantially rearwardly from top ends of the apertures 341 and a pair of protruding portions 343 extending upwardly from opposite sides thereof. Rear openings of the leading-wire cutouts 342 are corresponding to a front portion of the leading-wire notch 325. Each leg 35 comprises a latch 351 extending downwardly from a free end thereof.

The terminals 4 are received in the terminal-receiving part 3. Each terminal includes a leading-wire end 41 connecting a wire 344 and a contact portion 42 electrically connecting to a mating plug (not shown). Each leading-wire end 41 extends upwardly from a top portion of each aperture 341 respectively. A vertical portion (no labeled) of each terminal 4 is respectively received in the apertures 341 of the terminal-receiving part 3, and a horizontal portion (no labeled) of each terminal 4 is respectively received in the slits 312 of the terminal-receiving part 3.

The metal shell 5, made of a metal sheet, covers the insulative housing 2. The metal shell 5 includes a pair of side walls 51 each having a rectangular hole 511 aligning with the hole 211 of the insulative housing 2. Each side wall 51 comprises a grounding footer 512 extending backwardly from a rear end thereof.

Referring to FIGS. 1, 2, 3 and 4, in assembling, firstly, the terminals 4 are mounted into the terminal-receiving part 3, and wires 344 are connected to the leading-wire ends 41 of the terminals 4. The wires 344 passes the leading-wire cutouts 342, then through the leading-wire notch 325, finally extending into the leading-wire space 324. Secondly, the terminal-receiving part 3 is inserted into a rear portion of the housing 2. The horizontal portion 33 is received in the receiving groove 221. Each latch 351 of the legs 35 is respectively secured in the holes 222. The protruding portions 343 attaches to an inner surface of the top wall 23 of the insulative housing 2. The leading-wire space 324 communicates with the hole 211 of the insulative housing 2. The wires 344 extends out of the hole 211 of the insulative housing 2 from the leading-wire space 324. Finally, the shell 5 covers the insulative housing 2. The holes 511 communicates with the holes 211, so that the wires 344 extends out of a side portion of the modular jack 100.

It is to be understood, however, further though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent identify by the broad general meaning of the terms in which the appended claims are expressed.

What is claimed is:

1. A modular jack, comprising:

an insulative housing defining a mating face for mating with a complementary connector and the mounting face for mounting to a printed circuit board, said mating face and said mounting face commonly defining a front-to-back direction, and a first hole in a side wall in communication with exterior in a lateral direction perpendicular to said front-to-back direction;

a terminal-receiving part received in the insulative housing;

a pair of terminals received in the terminal-receiving part and each comprising a front contact portion extending to the mating face for mating with complementary connector; and a pair of wires connecting to rear portions of the corresponding terminals, respectively, and further extending into the exterior through said first hole.

2. The modular jack according to claim 1, wherein a metallic shell encloses the housing and defines a second hole in alignment with said first hole in said lateral direction, and the wires extend further through said second hole.

3. A modular jack comprising:

an insulative housing defining a mating face for mating with a complementary connector and the mounting face for mounting to a printed circuit board, said mating face and said mounting face commonly defining a front-to-back direction, and a hole in side wall in communication with exterior in a first lateral direction perpendicular to said front-to-back direction;

a terminal-receiving part received in the insulative housing;

a pair of terminals received in the terminal-receiving part and each comprising a front contact portion extending to the mating face for mating with the complementary connector; and a pair of wires connecting to rear portions of the corresponding terminals, respectively, wherein each of said wires initially extends toward one side wall along a second lateral direction perpendicular to both said first lateral direction and said vertical direction, successively into a centerline portion of the housing along said vertical direction, and finally extending into the exterior through said hole along said first lateral direction.

4. The modular jack according to claim 3, wherein a metallic shell encloses said housing and defines another hole in alignment with said hole in said first lateral direction.

5. The modular jack according to claim 1, wherein the housing defines a mounting device on the mounting face for mounting the housing unto said printed circuit board.

6. The modular jack according to claim 3, wherein the housing defines a mounting device on the mounting face for mounting the housing unto said printed circuit board.

7. The modular jack according to claim 1, wherein the first hole is fully surrounded by the housing and communicates with the exterior only through in said lateral direction.

8. The modular jack according to claim 3, wherein said hole is fully surrounded by the housing and communicates with the exterior in said lateral direction.

9. The modular jack according to claim 7, wherein said first hole is essentially located spaced from the mounting face.

10. The modular jack according to claim 8, wherein said hole is essentially located spaced from the mounting face.

* * * * *